US010173457B2

(12) United States Patent
Makita et al.

(10) Patent No.: US 10,173,457 B2
(45) Date of Patent: Jan. 8, 2019

(54) BINDING DEVICE AND IMAGE FORMING SYSTEM

(71) Applicant: FUJI XEROX CO., LTD., Tokyo (JP)

(72) Inventors: Takuya Makita, Kanagawa (JP); Hiroaki Awano, Kanagawa (JP); Kojiro Tsutsumi, Kanagawa (JP); Katsumi Harada, Kanagawa (JP); Toshiyasu Yukawa, Kanagawa (JP); Takashi Ogino, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/697,700

(22) Filed: Sep. 7, 2017

(65) Prior Publication Data

US 2018/0272790 A1 Sep. 27, 2018

(30) Foreign Application Priority Data

Mar. 22, 2017 (JP) ..... 2017-056660

(51) Int. Cl.

| | |
|---|---|
| ***B31F 5/02*** | (2006.01) |
| ***B42F 3/00*** | (2006.01) |
| ***G03G 15/00*** | (2006.01) |
| ***B65H 31/30*** | (2006.01) |

(52) U.S. Cl.

CPC ..... *B42F 3/006* (2013.01); *B31F 5/02* (2013.01); *B65H 31/3081* (2013.01); *G03G 15/6544* (2013.01); *G03G 2215/00827* (2013.01); *G03G 2215/00848* (2013.01)

(58) Field of Classification Search

CPC ..... B42F 3/006; B31F 5/02; B65H 31/3081; G03G 15/6544; G03G 2215/00827; G03G 2215/00848

USPC ..... 270/58.08

See application file for complete search history.

(56) References Cited

U.S. PATENT DOCUMENTS

| | | | | |
|---|---|---|---|---|
| 8,983,362 | B2 * | 3/2015 | Nakamura | B65H 37/04 270/58.08 |
| 2017/0174465 | A1 * | 6/2017 | Morinaga | B31F 5/02 |
| 2017/0282482 | A1 * | 10/2017 | Awano | B31F 5/02 |
| 2017/0283207 | A1 * | 10/2017 | Makita | B65H 37/04 |

FOREIGN PATENT DOCUMENTS

JP 2010-274623 A 12/2010

* cited by examiner

*Primary Examiner* — Leslie A Nicholson, III
(74) *Attorney, Agent, or Firm* — Sughrue Mion, PLLC

(57) ABSTRACT

A binding device includes a first pressing member that presses a recording-medium stack from one surface side of the recording-medium stack, a second pressing member disposed at a position opposed to the first pressing member to press the recording-medium stack from the other surface side of the recording-medium stack, and a reduction part provided in at least one pressing member of the first pressing member and the second pressing member to reduce creases in recording media of the recording-medium stack in a binding operation when a number of the recording media in the recording-medium stack is smaller than a maximum number of recording media to be bound by the first pressing member and the second pressing member.

4 Claims, 9 Drawing Sheets

BINDING DEVICE AND IMAGE FORMING SYSTEM

CROSS-REFERENCE TO RELATED APPLICATIONS

This application is based on and claims priority under 35 USC 119 from Japanese Patent Application No. 2017-056660 filed Mar. 22, 2017.

BACKGROUND

(i) Technical Field

The present invention relates to a binding device and an image forming system.

(ii) Related Art

In a binding device, a recording-medium stack is sometimes bound by pressing a pressing member against the recording-medium stack to partly deform recording media in the recording-medium stack.

SUMMARY

According to an aspect of the invention, there is provided a binding device including a first pressing member that presses a recording-medium stack from one surface side of the recording-medium stack, a second pressing member disposed at a position opposed to the first pressing member to press the recording-medium stack from the other surface side of the recording-medium stack, and a reduction part provided in at least one pressing member of the first pressing member and the second pressing member to reduce creases in recording media of the recording-medium stack in a binding operation when a number of the recording media in the recording-medium stack is smaller than a maximum number of recording media to be bound by the first pressing member and the second pressing member.

BRIEF DESCRIPTION OF THE DRAWINGS

Exemplary embodiments of the present invention will be described in detail based on the following figures, wherein.

DETAILED DESCRIPTION

First Exemplary Embodiment

Exemplary Embodiments of the present invention will be described in detail below with reference to the attached drawings.

Figure 1:
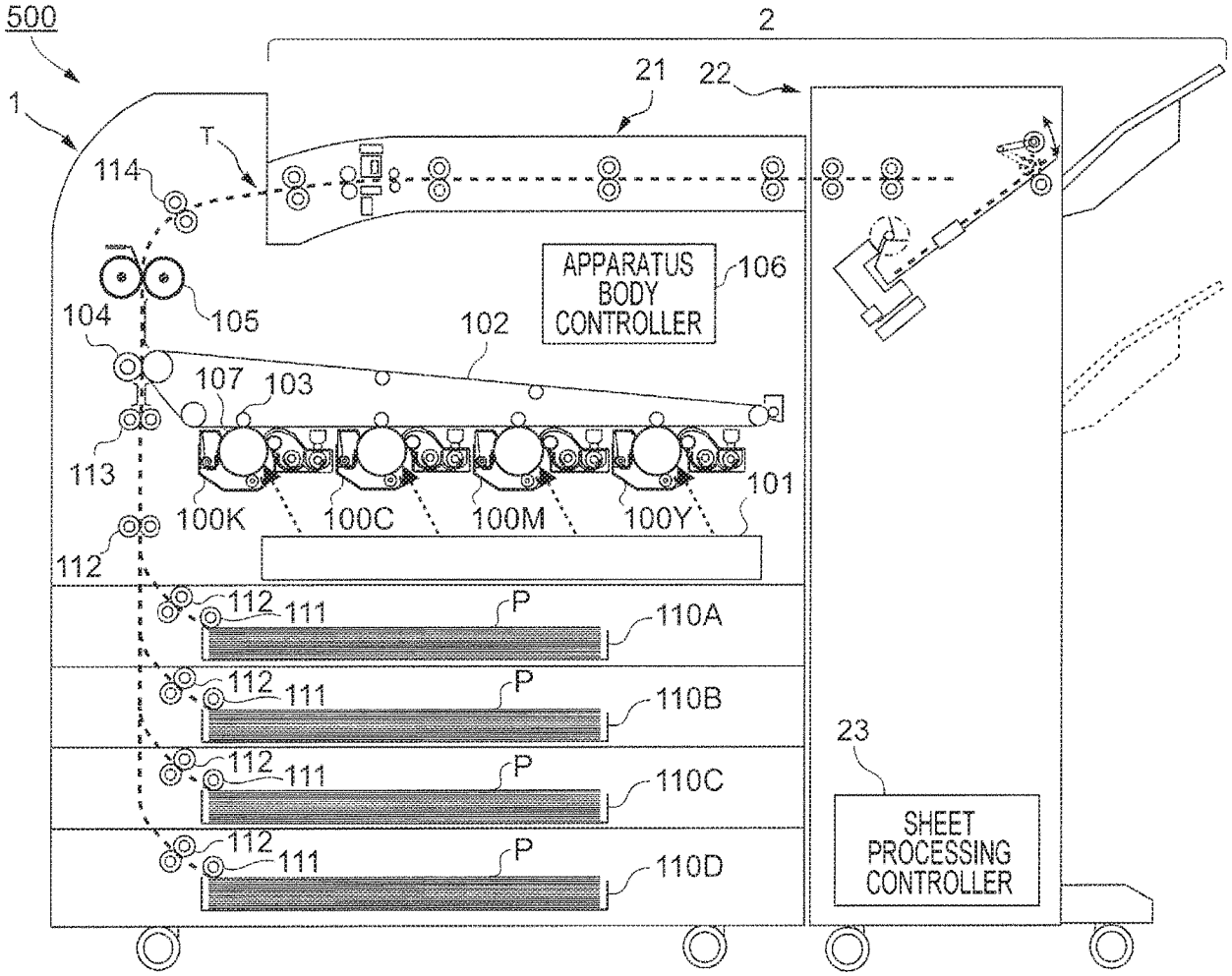
FIG. 1 illustrates a configuration of an image forming system.

FIG. 1 illustrates a configuration of an image forming system 500 according to a first exemplary embodiment.

The image forming system 500 illustrated in FIG. 1 includes an image forming apparatus 1, such as a printer or a copying machine, which forms color images on sheets P serving as an example of a recording medium, and a post-processing apparatus 2 that conducts post processing, such as binding, on the sheets P on which images are formed by the image forming apparatus 1.

The image forming apparatus 1 serving as an example of an image forming section includes four image forming units 100Y, 100M, 100C, and 100K (also generically referred to as "image forming units 100") which perform image formation according to color image data.

The image forming apparatus 1 further includes a laser exposure device 101 that exposes photoconductor drums 107 provided in the image forming units 100. The image forming apparatus 1 further includes an intermediate transfer belt 102 on which color toner images formed by the image forming units 100 are multi-transferred.

The image forming apparatus 1 further includes first transfer rollers 103 that transfer (first-transfer) the color toner images formed by the image forming units 100 onto the intermediate transfer belt 102 in order, a second transfer roller 104 that collectively transfers (second-transfers) the color toner images transferred on the intermediate transfer belt 102 onto a sheet P, and a fixing device 105 that fixes the second-transferred color toner images onto the sheet P. The image forming apparatus 1 further includes an apparatus body controller 106 constituted by a program-controlled CPU to control the operation of the image forming apparatus 1.

In each of the image forming units 100 of the image forming apparatus 1, a toner image of the corresponding color is formed through, for example, a step of charging a photoconductor drum 107, a step of forming an electrostatic latent image on the photoconductor drum 107 by scanning exposure from the laser exposure device 101, and a step of developing the formed electrostatic latent image with color toner.

The color toner images formed in the image forming units 100 are electrostatically transferred (first-transferred) in order onto the intermediate transfer belt 102 by the first transfer rollers 103. Then, the color toner images are transported to an installation position of the second transfer roller 104 along with movement of the intermediate transfer belt 102.

On the other hand, in the image forming apparatus 1, plural sheets P having different sizes and different paper types are stored in paper containers 110A to 110D.

When images are formed on sheets P, for example, sheets P are taken out from the paper container 110A by a pickup roller 111, and are transported one by one to the position of a registration roller 113 by a transport roller 112.

Then, the sheet P is supplied from the registration roller 113 in timing to the time when the color toner images on the intermediate transfer belt 102 are transported to the position of the second transfer roller 104.

Thus, the color toner images are collectively and electrostatically transferred (second-transferred) onto the sheet P by the action of a transfer electric field formed by the second transfer roller 104.

After that, the sheet P with the second-transferred color toner images is peeled off from the intermediate transfer belt 102, and is transported to the fixing device 105. In the fixing device 105, the color toner images are fixed on the sheet P by a fixing operation using heat and pressure to form an image.

The sheet P having the image is output from a sheet output unit T of the image forming apparatus 1 by a transport roller 114, and is supplied to the post-processing apparatus 2.

The post-processing apparatus 2 serving as an example of a binding device is disposed on the downstream side of the sheet output unit T of the image forming apparatus 1, and conducts post processing, such as punching and binding, on the sheet P having the image formed thereon.

Figure 2:
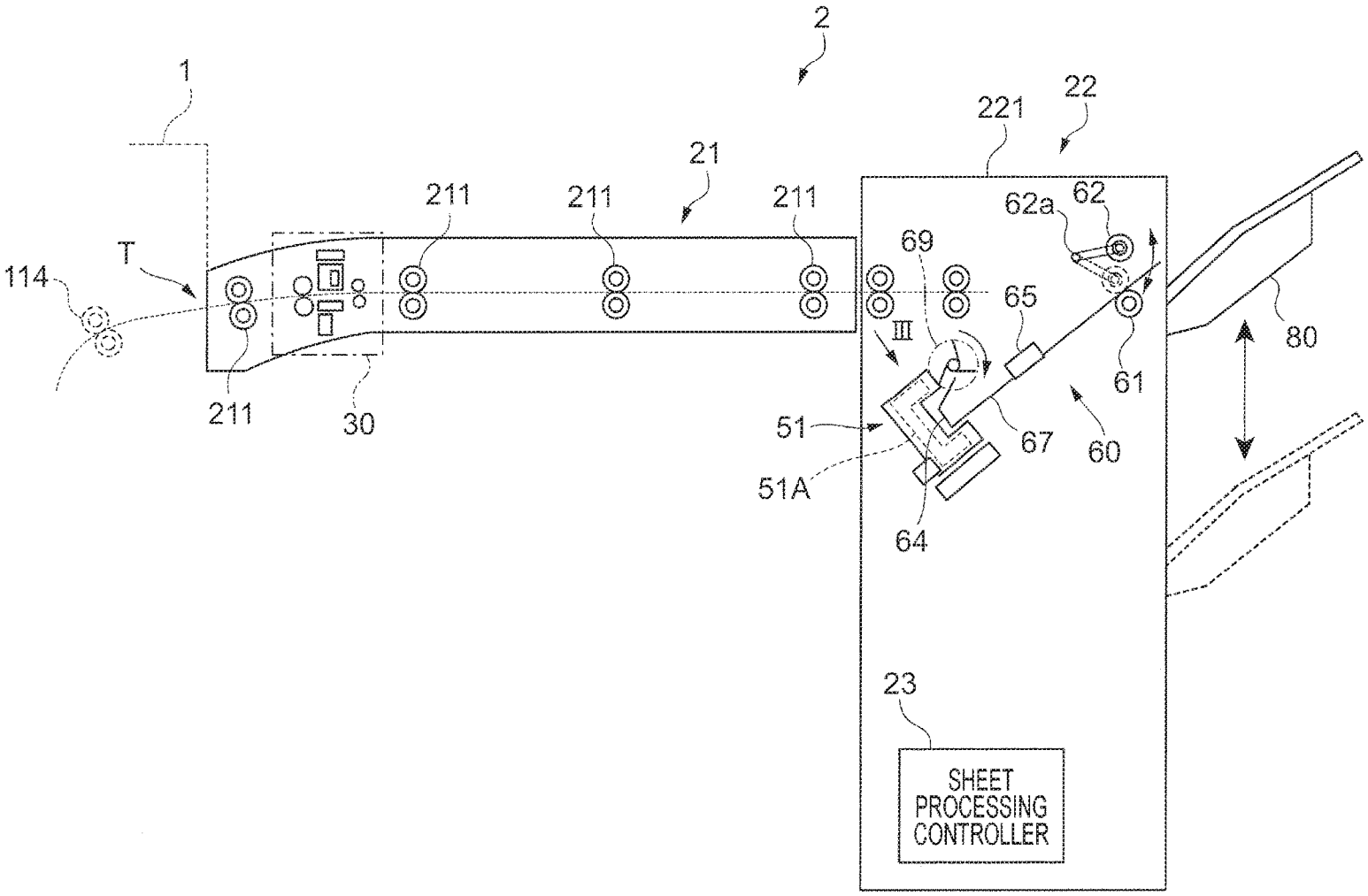
FIG. 2 illustrates a structure of a post-processing apparatus.

FIG. 2 illustrates the structure of the post-processing apparatus 2.

The post-processing apparatus 2 includes a transport unit 21 connected to the sheet output unit T of the image forming apparatus 1, and a finisher unit 22 that conducts predetermined processing on a sheet P transported by the transport unit 21.

The post-processing apparatus 2 further includes a sheet processing controller 23 constituted by a program-controlled CPU to control the mechanisms in the post-processing apparatus 2. The sheet processing controller 23 is connected to the apparatus body controller 106 (see FIG. 1) through an unillustrated signal line, and the sheet processing controller 23 and the apparatus body controller 106 mutually transmit and receive control signals and the like.

The transport unit 21 of the post-processing apparatus 2 includes a punching function part 30 that makes, for example, two holes or four holes (punching) and plural transport rollers 211 that transport the sheet P toward the finisher unit 22 after the image is formed on the sheet P in the image forming apparatus 1.

On the other hand, the finisher unit 22 includes a finisher unit body 221, a sheet accumulation part 60 on which a required number of sheets P are accumulated to form a sheet stack, and a binding unit 51 that binds an edge portion of the sheet stack formed in the sheet accumulation part 60 (edge binding).

The finisher unit 22 further includes a rotatable transport roller 61 used to transport the sheet stack formed in the sheet accumulation part 60. The finisher unit 22 further includes a movable roller 62 disposed pivotally on a pivot axis 62*a* to be movable between a position retreated from the transport roller 61 and a position in pressing contact with the transport roller 61.

The finisher unit 22 is provided with a stacker 80 on which the sheet stack transported by the transport roller 61 and the movable roller 62 is stacked. The stacker 80 moves up and down according to the number of sheet stacks to be held.

To perform the processing of the post-processing apparatus 2, a sheet P is first transported from the image forming apparatus 1 into the transport unit 21 of the post-processing apparatus 2.

In the transport unit 21, the sheet P is punched by the punching function part 30, and is then transported to the finisher unit 22 by the transport rollers 211.

When there is no command to perform punching, the sheet p is directly sent to the finisher unit 22 without being punched by the punching function part 30.

The sheet P sent to the finisher unit 22 is transported to the sheet accumulation part 60. Specifically, the sheet P is transported above the sheet accumulation part 60, and then falls onto the sheet accumulation part 60. This sheet P is supported from below by a support plate 67 provided in the sheet accumulation part 60. Further, the sheet P is slid on the support plate 67 by an inclined movable paddle 69 attached to the support plate 67.

After that, the sheet P abuts on an end guide 64 attached to an end portion of the support plate 67. The movement of the sheet P is thereby stopped in the first exemplary embodiment.

Subsequently, this operation is performed every time a sheet P is transported from the upstream side, and a sheet stack (recording-medium stack) is formed on the sheet accumulation part 60 while rear edge portions of sheets P in the sheet stack are aligned.

In the first exemplary embodiment, two aligning members 65 are provided movably in the width direction of the sheet stack (movable in a direction orthogonal to the paper plane of FIG. 2) to align the sheet stack in the width direction.

Of the two aligning members 65, one aligning member 65 is disposed on one side in the width direction of the sheet stack, and the other aligning member 65 is disposed on the other side in the width direction of the sheet stack.

In the first exemplary embodiment, every time a sheet P is supplied onto the support plate 67, edge portions (side portions) of the sheet P in the width direction are pressed by the aligning members 65 to align the sheet P (sheet stack) in the width direction.

When a predetermined number of sheets P are stacked on the support plate 67 and a sheet stack is formed on the support plate 67, the binding unit 51 performs a binding operation of binding an end portion of the sheet stack.

In the binding unit 51, a pressing member pair (to be described later) is provided to press the sheet stack. This pressing member pair includes an upper pressing member and a lower pressing member (to be described later). In the first exemplary embodiment, an advancing and retreating mechanism 51A is further provided to advance and retreat one of the upper pressing member and the lower pressing member relative to the other pressing member.

In the first exemplary embodiment, sheets that constitute a sheet stack are pressure-bonded and bound by pressing the upper pressing member and the lower pressing member against the sheet stack from both sides of the sheet stack. In other words, in the first exemplary embodiment, the sheet stack is bound without using any needle such as a staple.

In the first exemplary embodiment, when the binding operation for the sheet stack is finished, the movable roller 62 advances toward the transport roller 61, and the transport roller 61 and the movable roller 62 clamp the sheet stack. After that, the transport roller 61 and the movable roller 62 are rotated to transport the bound sheet stack to the stacker 80.

Figure 3:
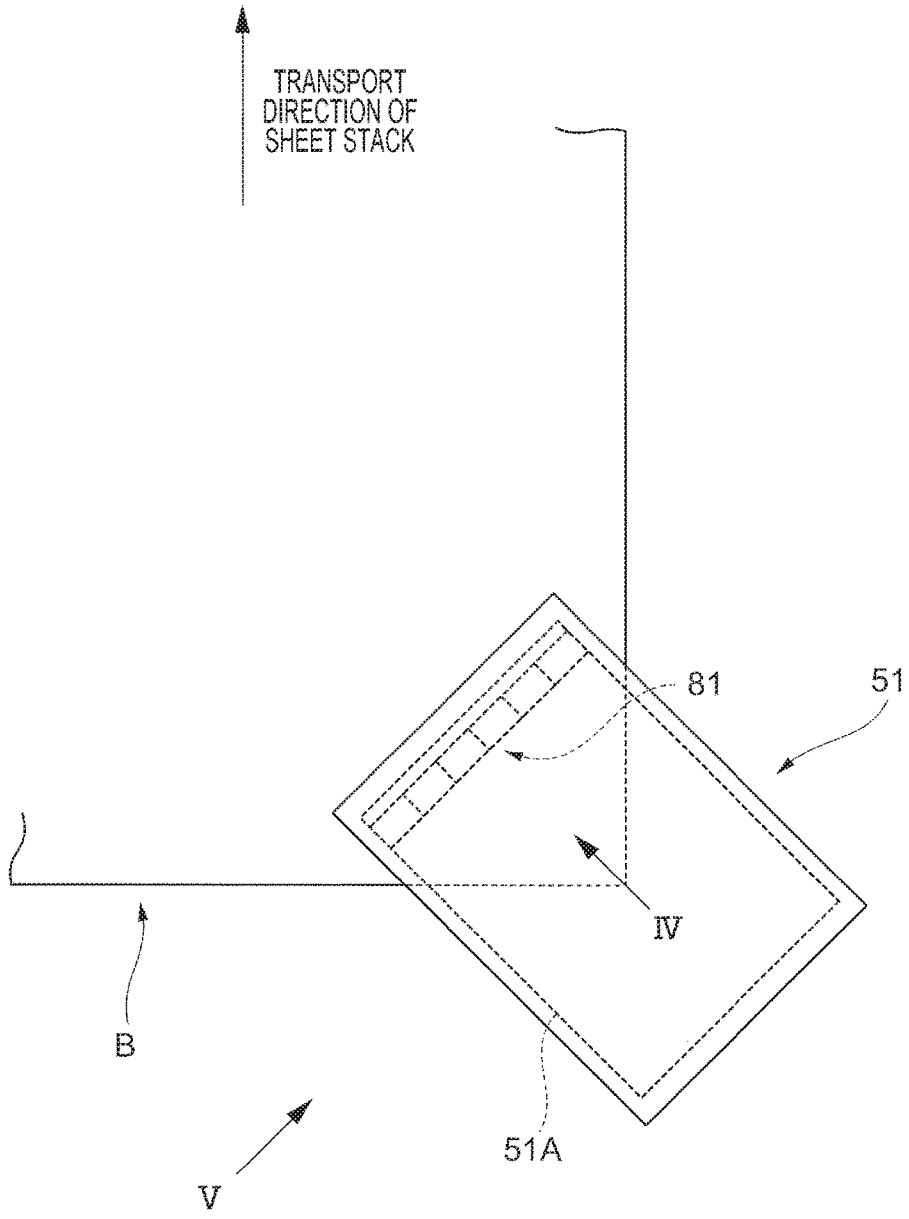
FIG. 3 illustrates a binding unit and so on, when viewed from a direction of arrow III in FIG. 2.

FIG. 3 illustrates the binding unit 51 and so on, when viewed from a direction of arrow III in FIG. 2.

As illustrated in FIG. 3, in the first exemplary embodiment, the binding unit 51 is disposed at an angle to the transport direction of a sheet stack B. In the first exemplary embodiment, the binding unit 51 binds a corner portion of the sheet stack B.

The binding unit 51 of the first exemplary embodiment includes a pressing member pair 81.

Figure 4:
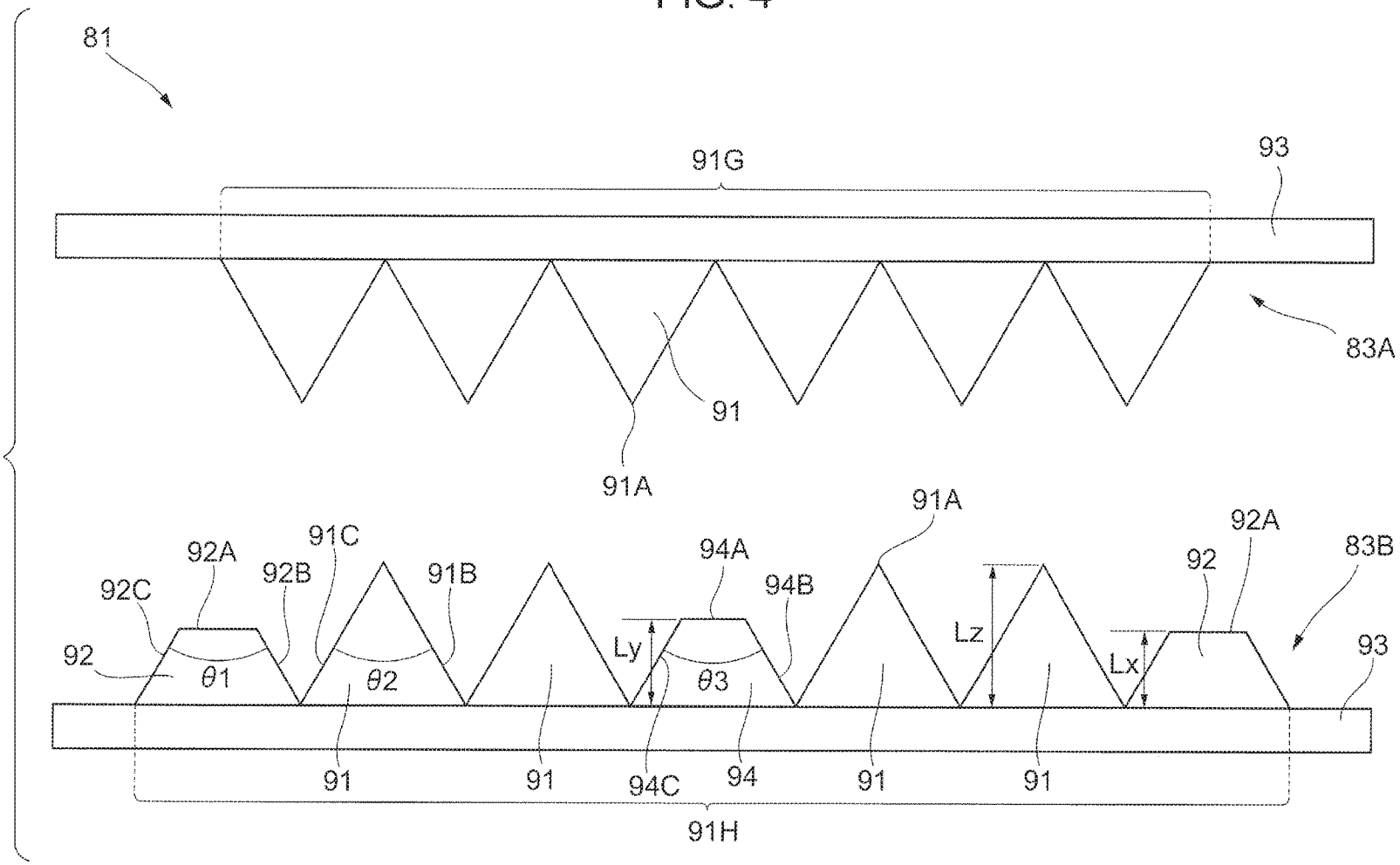
FIG. 4 illustrates a pressing member pair, when viewed from a direction of arrow IV in FIG. 3.

FIG. 4 illustrates the pressing member pair 81, when viewed from a direction of arrow IV in FIG. 3.

As illustrated in FIG. 4, the pressing member pair 81 includes an upper pressing member 83A and a lower pressing member 83B.

As illustrated in FIG. 4, the upper pressing member 83A has a projection group 91G. The lower pressing member 83B has a projection group 91H. The projection group 91G is disposed at a position opposed to the projection group 91H.

In the projection group 91G of the upper pressing member 83A, plural projections 91 are arranged. Specifically, six projections 91 are arranged in the projection group 91G.

In the projection group 91H of the lower pressing member 83B, plural projections 91, end-side low projections 92 serving as a reduction part, and a center low projection 94 are arranged. Specifically, in the projection group 91H, four projections 91, two end-side low projections 92, and one center low projection 94 are arranged.

The plural projections 91 extend in one direction (extend along a direction orthogonal to the paper plane of FIG. 4). Further, the projections 91 are triangular in cross section. Still further, the plural projections 91 extend in one direction (extend in the direction orthogonal to the paper plane of FIG. 4) and are arranged in a direction orthogonal to the one direction (a right-left direction in FIG. 4).

In the first exemplary embodiment, each of the upper pressing member 83A and the lower pressing member 83B includes a base 93 shaped like a rectangular parallelepiped, and the plural projections 91 project from a surface of the base 93. Each of the projections 91 has a top portion 91A at a distal end in the projecting portion (up-down direction in FIG. 4).

The end-side low projections 92 are disposed in end portions (one end portion and the other end portion) of the projection group 91H in the longitudinal direction (right-left direction in FIG. 4).

The center low projection 94 is disposed in a center portion of the projection group 91H in the longitudinal direction.

In the first exemplary embodiment, an end-side low projection 92, two projections 91, a center low projection 94, two projections 91, and an end-side low projection 92 are arranged in order from the left side of the lower pressing member 83B in the longitudinal direction in FIG. 4.

The end-side low projections 92 and the center low projection 94 are trapezoidal in cross section. Also, the end-side low projections 92 and the center low projection 94 project from the surface of the base 93. The end-side low projections 92 have their respective top portions 92A at distal ends in the projecting direction (up-down direction in FIG. 4), and the center low projection 94 has a top portion 94A at a distal end in the projecting direction.

The end-side low projections 92 and the center low projection 94 are smaller in height than the projections 91.

Specifically, a distance Lx from the top portions 92A of the end-side low projections 92 to the surface of the base 93 (distance in the up-down direction in FIG. 4) is shorter than a distance Lz from the top portions 91A of the projections 91 to the surface of the base 93. Also, a distance Ly from the top portion 94A of the center low projection 94 to the surface of the base 93 (distance in the up-down direction in FIG. 4) is shorter than the distance Lz from the top portions 91A of the projections 91 to the surface of the base 93.

In other words, the projection amounts of the end-side low projections 92 and the center low projection 94 from the base 93 are smaller than that of the projections 91. Here, the projections 91 may be regarded as high projections whose projection amount from the base 93 is larger than those of the end-side low projections 92 and the center low projection 94.

In the first exemplary embodiment, the end-side low projections 92 are smaller in height than the center low projection 94.

Specifically, the distance Lx from the top portions 92A of the end-side low projections 92 to the surface of the base 93 is shorter than the distance Ly from the top portion 94A of the center low projection 94 to the surface of the base 93.

In other words, the projection amount of the end-side low projections 92 from the base 93 is smaller than that of the center low projection 94.

In the first exemplary embodiment, an angle θ1 formed between one side surface 92B and the other side surface 92C of each end-side low projection 92 is equal to an angle θ2 formed between one side surface 91B and the other side surface 91C of each projection 91.

In the first exemplary embodiment, an angle θ3 formed between one side surface 94B and the other side surface 94C of the center low projection 94 is equal to the angle θ2 formed between the one side surface 91B and the other side surface 91C of each projection 91.

When a binding operation is performed for a sheet stack, the projections have a desired size according to the thickness of the sheet stack. Specifically, the size and pitch of the projections preferably increase as the thickness of the sheet stack increases.

In the first exemplary embodiment, the plural projections 91 in the pressing member pair 81 are large, and these projections 91 are suited to bind a thick sheet stack. In the first exemplary embodiment, for example, a sheet stack in which the maximum number of sheets is ten is bound by using the pressing member pair 81.

The maximum number of sheets refers to the value described as the maximum number of sheets in the sheet stack to be bound in the specifications of, for example, product catalogues. In other words, the maximum number of sheets is, for example, the upper limit of the number of sheets in the sheet stack to be properly bound by the pressing member pair 81.

Figure 5A:
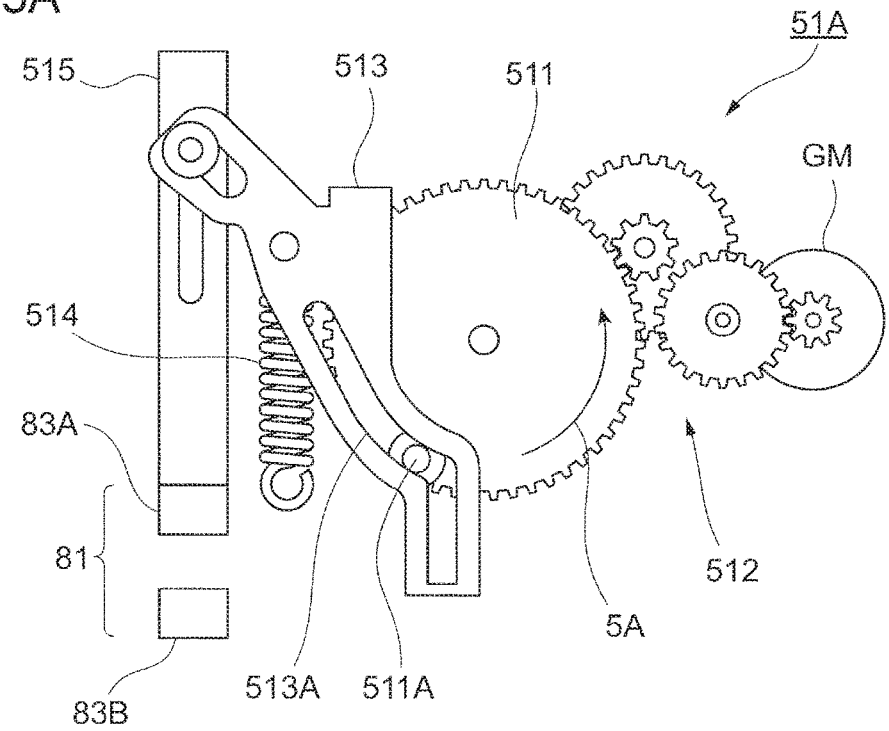
FIGS. 5A and 5B illustrate an advancing and retreating mechanism, when viewed from a direction of arrow V in FIG. 3.
Figure 5B:
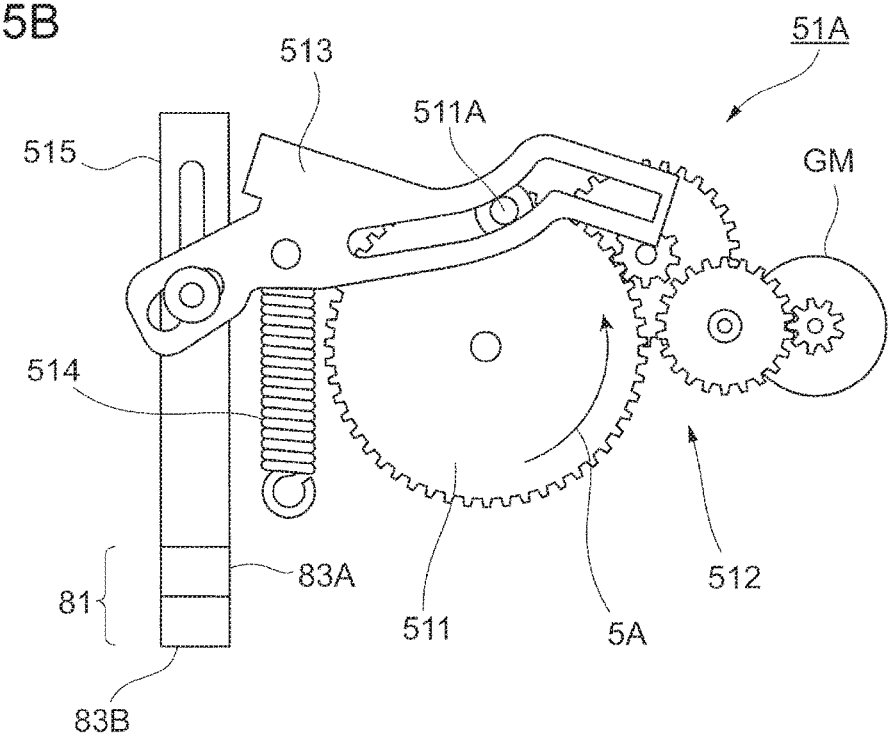

FIGS. 5A and 5B illustrate the advancing and retreating mechanism 51A, when viewed from a direction of arrow V in FIG. 3.

As illustrated in FIG. 5A, the advancing and retreating mechanism 51A of the first exemplary embodiment includes a rotation gear 511. Further, the advancing and retreating mechanism 51A includes a gear motor GM for rotating the rotation gear 511 and a transmission gear 512 for transmitting the rotation driving force from the gear motor GM to the rotation gear 511. On a side surface of the rotation gear 511, a projecting portion 511A is provided.

The advancing and retreating mechanism 51A further includes a crank member 513 for making a pivotal motion. The crank member 513 has a slot 513A, and the projecting portion 511A of the rotation gear 511 is located inside the slot 513A.

The advancing and retreating mechanism 51A further includes a spring 514 for biasing the crank member 513 downward. An advancing and retreating member 515 is attached to a left end portion of the crank member 513 in FIGS. 5A and 5B, and advances and retreats in the up-down direction. In the first exemplary embodiment, the upper pressing member 83A is attached to a lower end portion of the advancing and retreating member 515.

FIG. 5A illustrates a state in which the advancing and retreating member 515 is moved up and the upper pressing member 83A is retreated from the lower pressing member 83B.

During a binding operation, the gear motor GM is driven, the rotation gear 511 rotates in a direction of arrow 5A in FIG. 5A, and the rotation gear 511 and so on are brought into a state of FIG. 5B.

In the state of FIG. 5B, the projecting portion 511A of the rotation gear 511 is located at an upper position, and a right end portion of the crank member 513 in FIG. 5B is raised.

Further, the crank member 513 is pulled downward by the spring 514, and the advancing and retreating member 515 is moved downward. Thus, the upper pressing member 83A is pressed against a sheet stack (not illustrated in FIGS. 5A and 5B). In this case, the sheet stack is clamped between the upper pressing member 83A and the lower pressing member 83B, and sheets that constitute the sheet stack are pressure-bonded.

Figure 6A:
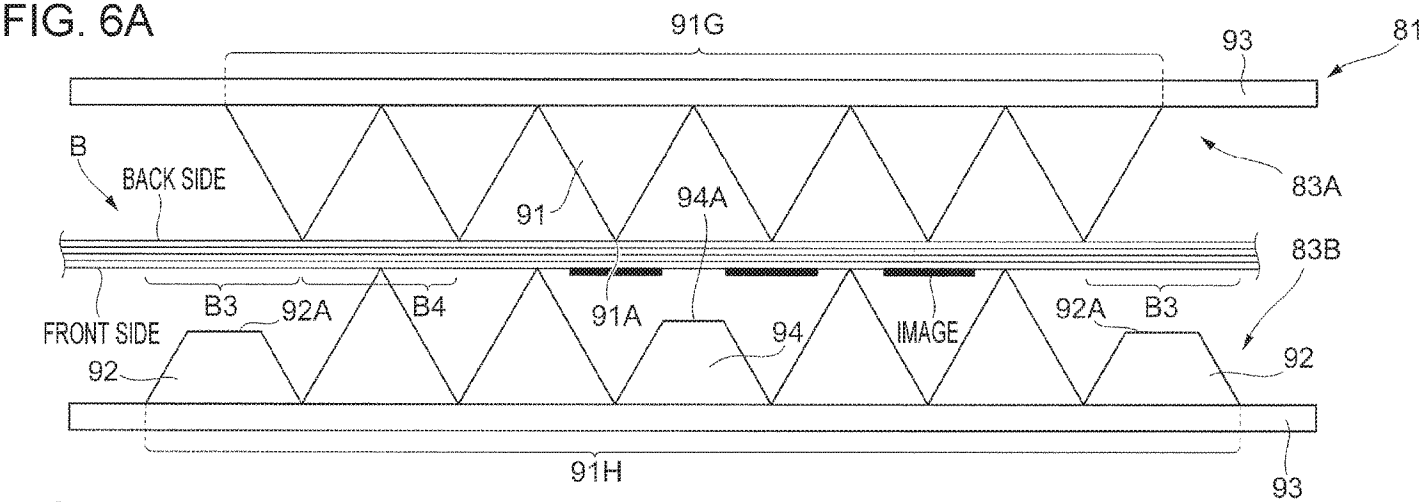
FIGS. 6A and 6B illustrate the movement of the pressing member pair during a binding operation.
Figure 6B:
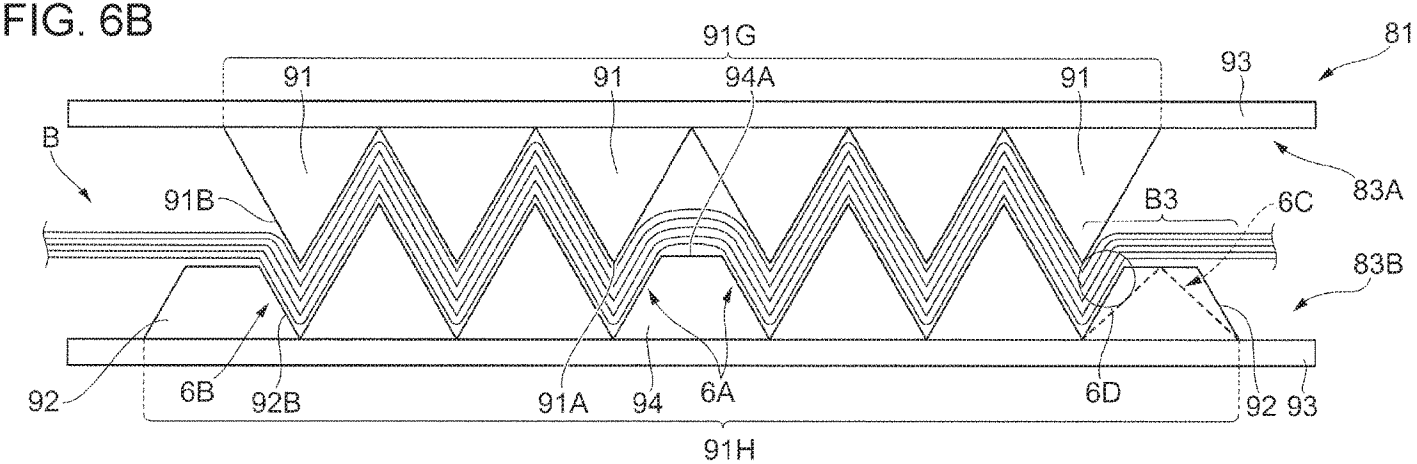

FIGS. 6A and 6B illustrate the action of the pressing member pair 81 during the binding operation.

During the binding operation, the upper pressing member 83A is moved down toward the lower pressing member 83B from the state of FIG. 4 (the sheet stack is not illustrated in FIG. 4) by the advancing and retreating mechanism 51A (see FIGS. 5A and 5B). When the upper pressing member 83A is moved downward, as illustrated in FIG. 6A, the top portions 91A of the projections 91 in the upper pressing member 83A (top portion 91A of each projection 91) are pressed against a sheet stack B. Also, the top portions 91A of the projections 91 in the lower pressing member 83B are pressed against the sheet stack B.

At this time, the end-side low projections 92 and the center low projection 94 are not in contact with the sheet stack B.

After that, as illustrated in FIG. 6B, the upper pressing member 83A further moves downward. When the upper pressing member 83A moves downward, each of the projections 91 of the upper pressing member 83A is inserted between two adjacent projections 91 of the lower pressing member 83B while pressing the sheet stack B.

Each of the projections 91 of the lower pressing member 83B is inserted between two adjacent projections 91 of the upper pressing member 83A while pressing the sheet stack B.

Thus, the sheet stack B is clamped between the projections 91 of the upper pressing member 83A and the projections 91 of the lower pressing member 83B.

At this time, the center low projection 94 abuts on the sheet stack B. Then, as shown by arrows 6A in FIG. 6B, the sheet stack B is clamped between the center low projection 94 and the projections 91 in the upper pressing member 83A.

Further, the end-side low projections 92 abut on the sheet stack B. Then, as shown by arrow 6B in FIG. 6B, the sheet stack B is clamped between one side surface 92B of each of the end-side low projections 92 and one side surface 91B of the corresponding projection 91 in the upper pressing member 83A.

In the first exemplary embodiment, when the upper pressing member 83A retreats, the binding operation for the sheet stack B is completed.

Figure 7:
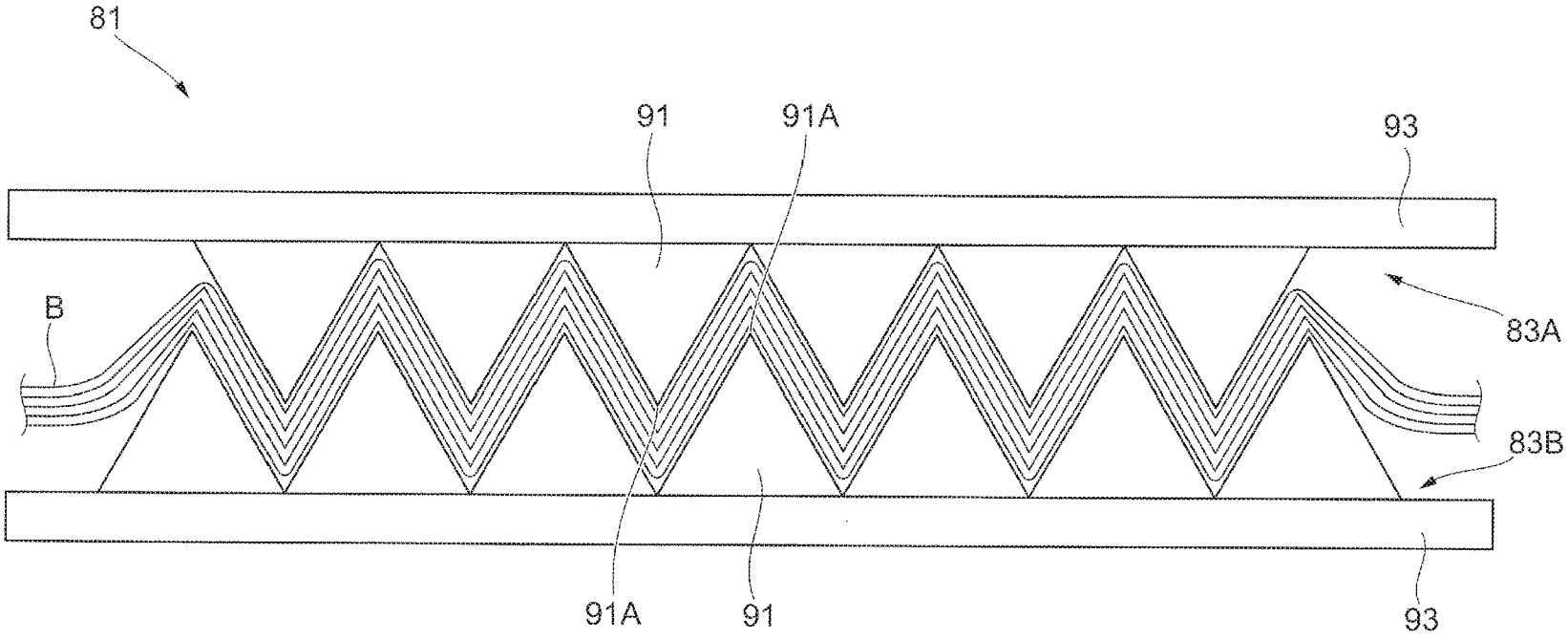
FIG. 7 explains a binding operation for a sheet stack using a pressing member pair according to a comparative example.

FIG. 7 explains an operation of binding a sheet stack B by using a pressing member pair 81 according to a comparative example. Structures similar to those of the first exemplary embodiment are denoted by the same reference numerals.

In the structure illustrated in FIG. 7, low projections are not provided in any of upper and lower pressing members (an upper pressing member 83A and a lower pressing member 83B). Specifically, in each of the upper pressing member 83A and the lower pressing member 83B, plural projections 91 are successively arranged from one end portion to the other end portion of the pressing member pair 81 in the right-left direction in FIG. 7.

According to the comparative example illustrated in FIG. 7, the projections 91 are inserted deep in the opposed pressing member all over the pressing member pair 81 in the longitudinal direction. In this case, the deformation amount of pressed portions of the sheet stack B against which the pressing member pair 81 is pressed increases.

Particularly in this comparative example, when a sheet stack B composed of a small number of sheets is bound, the deformation amount of the sheet stack B easily increases.

In the comparative example, for example, when a binding operation is conducted on a sheet stack B composed of the maximum number of sheets (for example, ten sheets) to be bound by the pressing member pair 81, since the sheet stack B is thick, deformation of the sheet stack B is suppressed.

On the other hand, when a binding operation is conducted on a sheet stack B composed of a number of sheets (for example, five sheets in FIG. 7) smaller than the maximum number of sheets, the sheet stack B is thin and is easily inserted deep between two adjacent projections 91. In this case, the deformation amount of pressed portions of the sheet stack B against which the pressing member pair 81 is pressed increases, and creases easily occur around the pressed portions.

In contrast, when the pressing member pair 81 includes the end-side low projections 92 (see FIG. 6B), as in the first exemplary embodiment, the end-side low projections 92 shorter than the projections 91 are not inserted deep in the opposed upper pressing member 83A.

The portions of the sheet stack B around the portions against which the pressing member pair 81 is pressed easily crease. In the first exemplary embodiment, the end-side low projections 92 are provided in the end portions (one end portion and the other end portion) in the longitudinal direction of the projection group 91H.

In particular, as illustrated in FIG. 6B, in the first exemplary embodiment, the end-side low projections 92 are located on the outermost sides in the arrangement direction of the plural projections of the upper and lower pressing members.

The end-side low projections 92 do not always need to be trapezoidal in cross section. As shown by arrow 6C in FIG. 6B, the end-side low projections 92 may be replaced with projections that are smaller and shorter than the projections 91 as a whole while maintaining the triangular cross-sectional shape.

When the projections have a trapezoidal cross-sectional shape and are reduced in height like the end-side low projections 92 of the first exemplary embodiment, the sheet stack B may be bound even at the end-side low projections 92.

For example, when the projections shown by arrow 6C in FIG. 6B are provided, a gap 6D between the projections 91 of the upper pressing member 83A and the projections of arrow 6C is larger than when the end-side low projections 92 are trapezoidal.

In such a case, the pressure acting on the sheet stack B decreases, and the bonding force between the sheets in the sheet stack B easily decreases.

In contrast, when the height is reduced by cutting the distal ends of the projections in the projecting direction, like the end-side low projections 92 of the first exemplary embodiment, the gap between the projections 91 of the upper pressing member 83A and the end-side low projections 92 of the lower pressing member 83B is suppressed from increasing.

In the first exemplary embodiment, three low projections (two end-side low projections 92 and one center low projection 94) are provided in the lower pressing member 83B.

For example, when only the projections having a large height (projections 91) are provided in the pressing member pair 81, as in the comparative example of FIG. 7, it may be difficult to bind a thin sheet stack.

Specifically, the size and pitch of the projection preferably decrease as the thickness of the sheet stack B decreases. When only the projections having a large height (projections 91) are provided, it may be difficult to bind the thin sheet stack B.

In contrast, when the low projections having a small height (center low projection 94 (see FIGS. 6A and 6B) and end-side low projections 92) are provided in the lower pressing member 83B, as in the first exemplary embodiment, the projections suitable for the thin sheet stack B are provided.

As the number of low projections provided in the lower pressing member 83B increases, the binding operation for the thin sheet stack B may become more reliable.

In the first exemplary embodiment, the center low projection 94 is provided in addition to the end-side low projections 92. This increases the number of low projections suited to bind the thin sheet stack B.

The center low projection 94 is provided between one end portion and the other end portion of the lower pressing member 83B in the longitudinal direction.

For example, even when the center low projection 94 is not provided, in the first exemplary embodiment, the end-side low projections 92 suitable to bind the thin sheet stack B are provided. The sheets that constitute the thin sheet stack B are pressure-bonded at the portions of the sheet stack B on which the end-side low projections 92 abut.

On the other hand, in this case (when the center low projection 94 is not provided), only the projections having a large height (projections 91) are provided in the center portion of the lower pressing member 83B in the longitudinal direction. In the center portion of the lower pressing member 83B in the longitudinal direction, the bonding force between the sheets may be decreased when the thin sheet stack B is bound.

In contrast, in the first exemplary embodiment, the center low projection 94 is provided in the center portion of the lower pressing member 83B.

While one center low projection 94 is provided in the center portion of the lower pressing member 83B in the longitudinal direction in the above, plural center low projections 94 may be provided.

The position of the center low projection 94 is not limited to the center portion of the lower pressing member 83B in the longitudinal direction, but the center low projection 94 may be provided closer to one end portion or the other end portion of the lower pressing member 83B in the longitudinal direction.

The height of the end-side low projections 92 may be larger than, smaller than, or equal to the height of the center low projection 94.

In the first exemplary embodiment, the height of the end-side low projections 92 is smaller than the height of the center low projection 94.

In the first exemplary embodiment, as illustrated in FIG. 6A, the lower pressing member 83B having the end-side low projections 92 is disposed below the upper pressing member 83A. In this case, the lower pressing member 83B abuts on a front side of the sheet stack B on which an image is formed.

The user normally refers to the sheet stack B from the front side of the sheet stack B. In this case, the lower pressing member 83B is pressed against the front side of the sheet stack B.

More specifically, in the first exemplary embodiment, while sheets on which images are formed by the image forming apparatus 1 (see FIG. 1) are supplied to the post-processing apparatus 2, they are supplied to (the (support plate 67 in) the post-processing apparatus 2 with surfaces of the sheets having the images (image forming surfaces) facing down.

Thus, in the first exemplary embodiment, the front side of the sheet stack B (an image forming surface side to be referred to by the user) faces the lower pressing member 83B having the end-side low projections 92, and the end-side low projections 92 abut on the front side.

In the first exemplary embodiment, the projection amount of the plural projections 91 from the base 93 in the upper pressing member 83A is larger than the projection amounts of the low projections (end-side low projections 92 and center low projection 94).

For example, when the projection amount of the plural projections 91 from the base 93 in the upper pressing member 83A is smaller than or equal to the projection amount of the low projections (end-side low projections 92 and center low projection 94), low projections are provided and it is difficult to bind a thick sheet stack B.

In the first exemplary embodiment, the projection amount of the plural projections 91 in the upper pressing member 83A is larger than the projection amount of the low projections (end-side low projections 92 and center low projection 94).

While the end-side low projections 92 and the center low projection 94 are provided only in the lower pressing member 83B in the first exemplary embodiment, the end-side low projections 92 and/or the center low projection 94 may also be provided in the upper pressing member 83A.

When the end-side low projections 92 are provided in the upper pressing member 83A, they are preferably provided in longitudinal end portions (one end portion and the other end portion) of the projection group 91G in the upper pressing member 83A, similarly to the lower pressing member 83B.

Second Exemplary Embodiment

Figure 8:
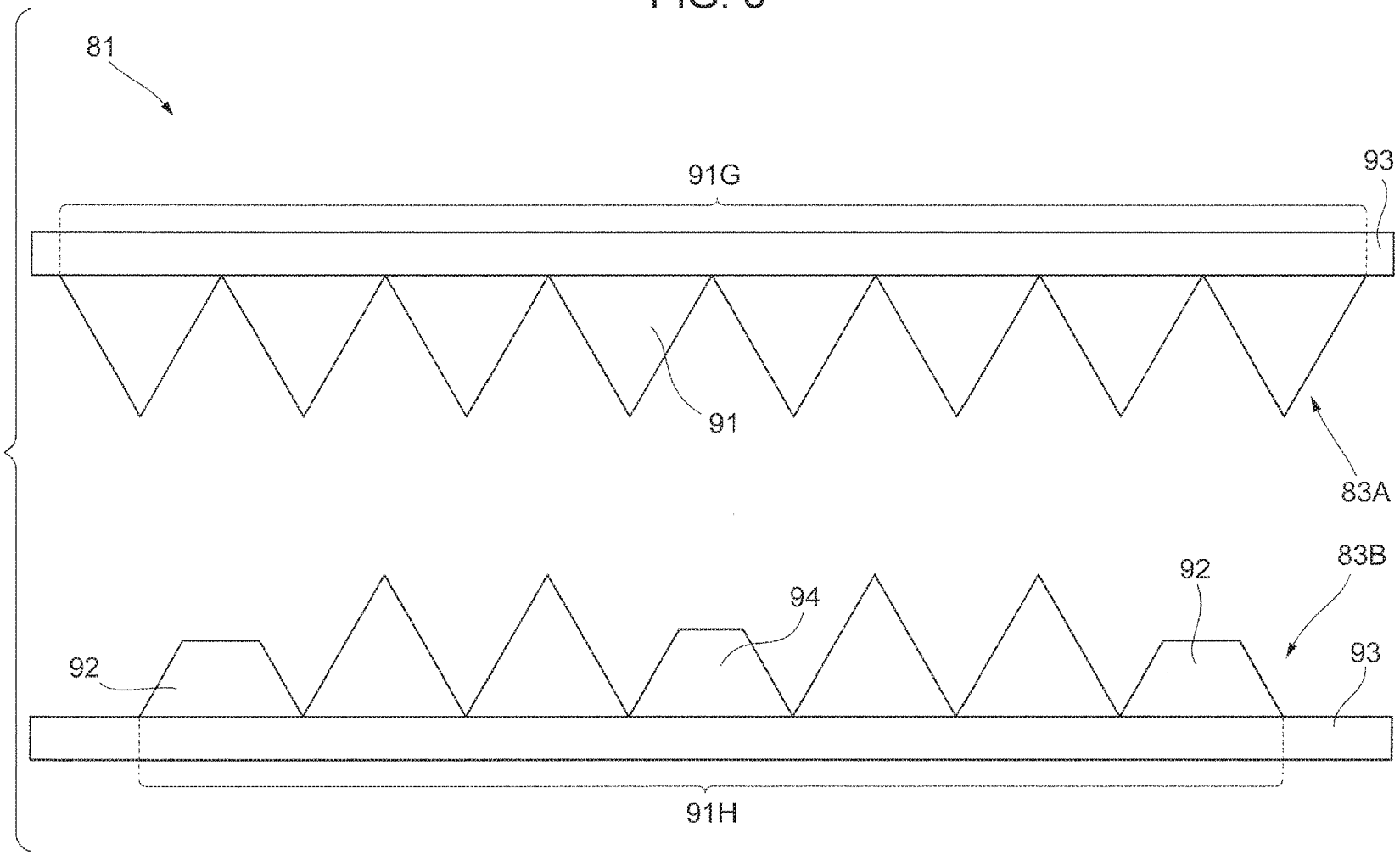
FIG. 8 illustrates a pressing member pair according to a second exemplary embodiment.

FIG. 8 illustrates a pressing member pair 81 according to a second exemplary embodiment. Structures similar to those of the first exemplary embodiment are denoted by the same reference numerals.

In this exemplary structure, as illustrated in FIG. 8, the pressing member pair 81 is composed of an upper pressing member 83A and a lower pressing member 83B.

The upper pressing member 83A includes a projection group 91G, and the lower pressing member 83B includes a projection group 91H.

While the end-side low projections 92 are provided in end portions of the pressing member having a larger number of projections in the above (the structure of FIG. 4), the structure including the end-side low projections 92 is not limited thereto, and the end-side low projections 92 may be provided, as illustrated in FIG. 8.

In the exemplary structure illustrated in FIG. 8, end-side low projections 92 are located in end portions of the pressing member having a small number of projections.

Third Exemplary Embodiment

Figure 9:
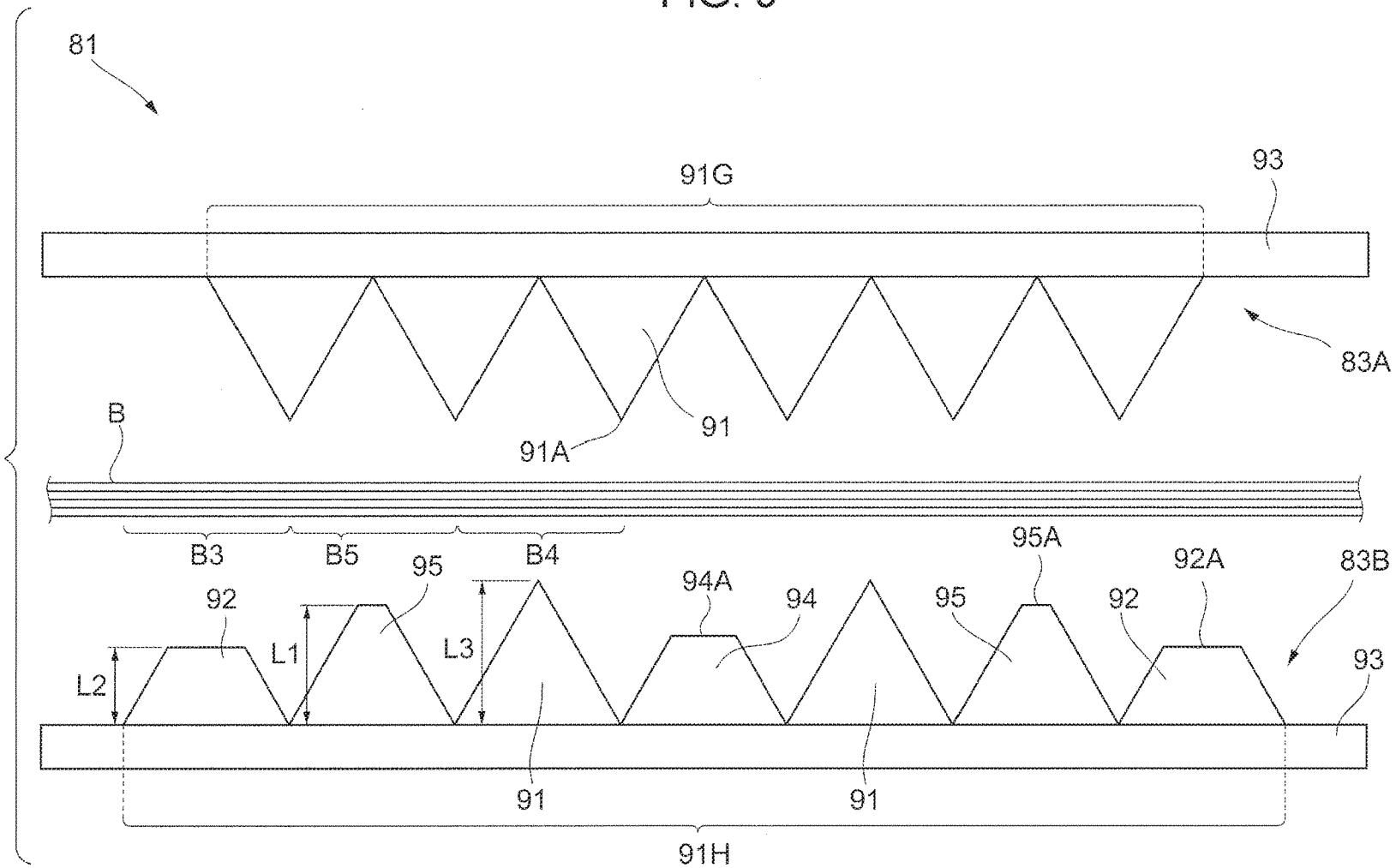
FIG. 9 illustrates a pressing member pair according to a third exemplary embodiment.

FIG. 9 illustrates a pressing member pair 81 according to a third exemplary embodiment. Structures similar to those of the first exemplary embodiment are denoted by the same reference numerals.

Even in this exemplary structure, a projection group 91G is also provided in an upper pressing member 83A and a projection group 91H is provided in a lower pressing member 83B.

In the third exemplary embodiment, the projection group 91H of the lower pressing member 83B includes end-side low projections 92, middle projections 95, projections 91, and a center low projection 94.

The center low projection 94 is provided in a center portion of the projection group 91H in the longitudinal direction. The end-side low projections 92 are provided in end portions of the projection group 91H in the longitudinal direction (one end portion and the other end portion). The projections 91 are provided on the left and right of the center low projection 94 in FIG. 9.

The middle projections 95 are provided between the end-side low projection 92 and the projection 91 in the one end portion of the projection group 91H in the longitudinal direction and between the end-side low projection 92 and the projection 91 in the other end portion of the projection group 91H.

Specifically, one middle projection 95 on the right side of FIG. 9 is located on the left of the end-side low projection 92 in the one end portion of the projection group 91H in the longitudinal direction (right end portion in FIG. 9) and on the right of the projection 91 located on the rightmost side of FIG. 9 (closest to the one end portion).

The other middle projection 95 on the left side in FIG. 9 is located on the right of the end-side low projection 92 in the other end portion of the projection group 91H in the longitudinal direction (left end portion in FIG. 9) and on the left of the projection 91 on the leftmost side in FIG. 9 (closest to the other end portion).

Further, the middle projections 95 are trapezoidal in cross section. The middle projections 95 project from a surface of a base 93, and have top portions 95A at distal ends in the projecting direction (up-down direction in FIG. 9).

The height of the middle projections 95 is larger than the height of the end-side low projections 92 and smaller than the height of the projections 91.

Specifically, a distance L1 from the top portions 95A of the middle projections 95 to the surface of the base 93 (distance L1 in the up-down direction in FIG. 9) is longer than a distance L2 from the top portions 92A of the end-side low projections 92 to the surface of the base 93 and shorter than a distance L3 from the top portions 91A of the projections 91 to the surface of the base 93. In other words, the projection amount of the middle projections 95 from the base 93 is larger than the projection amount of the end-side low projections 92 and smaller than the projection amount of the projections 91.

In the third exemplary embodiment, the center low projection 94, the projections 91, the middle projections 95, and the end-side low projections 92 of the projection group 91H in the lower pressing member 83B abut on a sheet stack B in a binding operation.

In the third exemplary embodiment, the middle projections 95 are provided between the projections 91 and the end-side low projections 92.

For example, when the projections 91 having a large height are located directly next to the end-side low projections 92, as in the exemplary structure of FIG. 6A, the portions of the sheet stack B against which the end-side low projections 92 and the projections 91 are pressed greatly distort, and this may deteriorate the appearance of the sheet stack B after the binding operation.

In contrast, in the third exemplary embodiment, the middle projections 95 are provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding device comprising:

a first pressing member configured to press a recording-medium stack by pressing a plurality of projections projecting from a base and having top portions at distal ends in a projecting direction against one surface side of the recording-medium stack; and a second pressing member disposed at a position opposed to the first pressing member, wherein the second pressing member is configured to press the recording-medium stack by pressing a plurality of projections projecting from a base and having top portions at distal ends in a projecting direction against the other surface side of the recording-medium stack, wherein the plurality of projections in at least one pressing member of the first pressing member and the second pressing member include low projections provided in one end portion and between the one end portion and another end portion in the at least one pressing member, wherein the top portion of the low projections is located closer to the base than the top portion of other projections, wherein the low projection in the at least one pressing member is disposed in one end portion and at a position closer to a center portion than the one end portion in an arrangement direction of the plurality of projections in the at least one pressing member, wherein a high projection is provided between an end-side low projection disposed in the one end portion and a center low projection disposed closer to the center portion than the one end portion in the arrangement direction, and a projection amount of the high projection from the base is larger than projection amounts of the low projections, and wherein a middle projection is provided between the high projection and the end-side low projection in the arrangement direction, and a projection amount of the middle projection from the base is larger than the projection amount of the end-side low projection and smaller than the projection amount of the high projection.

2. The binding device according to claim 1, wherein the at least one pressing member is configured to press a front side of the recording-medium stack on which an image is formed, and wherein the other pressing member is configured to press a back side of the recording-medium stack opposite from the front side.

3. The binding device according to claim 2, wherein a projection amount of the plurality of projections from the base in the other pressing member is larger than a projection amount of the low projection from the base.

4. An image forming system comprising:

an image forming section configured to form images on a plurality of recording media; and the binding device according to claim 1, wherein the binding device is configured to bind the plurality of recording media after the images are formed thereon by the image forming section.

* * * * *